US011506444B2

(12) United States Patent
Shultz et al.

(10) Patent No.: US 11,506,444 B2
(45) Date of Patent: Nov. 22, 2022

(54) DOOR FOR AN ICE MACHINE

(71) Applicant: Mile High Equipment LLC, Denver, CO (US)

(72) Inventors: Nathan Lee Shultz, Aurora, CO (US); Colin Michael Johnson, Denver, CO (US)

(73) Assignee: Mile High Equipment LLC, Denver, CO (US)

( * ) Notice: Subject to any disclaimer, the term of this patent is extended or adjusted under 35 U.S.C. 154(b) by 608 days.

(21) Appl. No.: 16/555,576

(22) Filed: Aug. 29, 2019

(65) Prior Publication Data

US 2021/0063077 A1 Mar. 4, 2021

(51) Int. Cl.

| | |
|---|---|
| ***F25D 23/02*** | (2006.01) |
| ***F25C 5/182*** | (2018.01) |
| ***E05F 5/00*** | (2017.01) |
| ***E05D 15/58*** | (2006.01) |

(52) U.S. Cl.

CPC ..... *F25D 23/021* (2013.01); *E05D 15/582* (2013.01); *E05F 5/003* (2013.01); *F25C 5/182* (2013.01); *F25D 23/028* (2013.01); *E05D 2015/586* (2013.01); *E05Y 2900/31* (2013.01); *F25C 2400/10* (2013.01)

(58) Field of Classification Search

CPC ... F25D 23/021; F25D 23/028; E05D 15/582; E05D 2015/586; E05F 5/003; F25C 5/182; F25C 2400/10; E05Y 2900/31

See application file for complete search history.

(56) References Cited

U.S. PATENT DOCUMENTS

| | | | | | |
|---|---|---|---|---|---|
| 4,471,624 | A | * | 9/1984 | Nelson | F25C 5/10 62/73 |
| 4,706,466 | A | | 11/1987 | Yingst | |
| 4,722,199 | A | | 2/1988 | Hibino | |
| 4,774,814 | A | * | 10/1988 | Yingst | F25C 1/12 62/352 |
| 5,042,263 | A | * | 8/1991 | Day | F25C 5/10 62/74 |
| 5,100,213 | A | | 3/1992 | Vandarakis | |
| 5,129,237 | A | * | 7/1992 | Day | F25C 1/12 62/73 |
| 5,193,357 | A | * | 3/1993 | Kohl | F25C 1/12 62/347 |

(Continued)

FOREIGN PATENT DOCUMENTS

| | | | |
|---|---|---|---|
| EP | 2273218 B1 | | 5/2014 |
| JP | 2002031441 A | * | 1/2002 |
| JP | 2008249191 A | * | 10/2008 |

*Primary Examiner* — Emmanuel E Duke

(74) *Attorney, Agent, or Firm* — Lempia Summerfield Katz LLC

(57) ABSTRACT

An ice machine includes a housing including a front panel, a first sidewall, a second sidewall opposite the first sidewall, and an opening. The first sidewall and the second sidewall extend away from the front panel. The ice machine also includes a guide at or adjacent to an inner surface of the first sidewall, an inner surface of the second sidewall, or an inner surface of the front panel. The ice machine includes a door movably coupled to the guide. From a first position of the door, the door is pivotable away from the opening and translatable along the guide down into a second position.

20 Claims, 7 Drawing Sheets

(56) References Cited

U.S. PATENT DOCUMENTS

| | | | | |
|---|---|---|---|---|
| 5,245,841 | A * | 9/1993 | Paul | F25D 23/006 62/344 |
| 5,752,393 | A * | 5/1998 | Schlosser | B08B 9/0325 62/303 |
| 6,109,043 | A * | 8/2000 | Lu | F25C 5/10 62/73 |
| 6,161,396 | A * | 12/2000 | Allison | F25C 1/12 228/183 |
| 6,311,501 | B1 * | 11/2001 | Allison | F25C 1/12 62/347 |
| 6,405,546 | B1 * | 6/2002 | Billman | F25C 1/12 62/135 |
| 7,195,744 | B2 * | 3/2007 | Kilawee | A61L 2/20 422/305 |
| 8,528,357 | B2 * | 9/2013 | Kondo | F25D 23/003 62/424 |
| 8,763,851 | B2 | 7/2014 | Jiang | |
| 2009/0126383 | A1 * | 5/2009 | Yamaguchi | F25D 23/006 62/449 |
| 2014/0137594 | A1 * | 5/2014 | Broadbent | F25C 1/04 62/459 |
| 2018/0164014 | A1 | 6/2018 | Kim | |

* cited by examiner

DOOR FOR AN ICE MACHINE

FIELD

The present embodiments relate to an ice machine and, more specifically, a door for an ice machine.

BACKGROUND

Commercial ice machines (e.g., icemakers) are used in a number of different types of foodservice and hospitality establishments. For example, commercial icemakers are used in bars, restaurants, hotels, hospitals, and other establishments for chilling drinks and keeping food cold during transport. In any of these establishments, a number of users may retrieve ice from an icemaker over the course of a day. For example, a number of bartenders and/or servers working at a bar or a restaurant may retrieve ice from an icemaker over the course of a day.

A door of the icemaker covers an opening through which ice stored within the icemaker is accessible. The door is movable by a user from a closed position into an open position, in which the opening is exposed and ice may be retrieved. The user may move the door in an upward direction. The user may then use one hand to hold the door open while using the other hand to retrieve ice from the icemaker. The user may contact an inner surface of the door with the one hand or both hands while holding the door open. Such contact between the user and the inner surface of the door, which faces the ice stored in the icemaker, may introduce contaminants to the inside of the icemaker, which may cause foodborne illness.

SUMMARY

In order to reduce the risk of contamination of ice within an icemaker, a door of an icemaker includes one or more portions that are pivotable within and translatable along one or more guides within the icemaker, respectively, such that the door pivots and translates between a first position of the door, a closed position, and a second position of the door, an open position. From the closed position, the door pivots away from an opening through a housing of the icemaker and translates down into the open position.

In a first aspect, an ice machine includes a housing. The housing includes a front panel, a first sidewall and a second sidewall opposite the first sidewall, and an opening. The first sidewall and the second sidewall extend in directions away from the front panel, respectively. The ice machine also includes a guide at or adjacent to an inner surface of the first sidewall, an inner surface of the second sidewall, or an inner surface of the front panel, and a door movably coupled to the guide. From a first position of the door, the door is pivotable away from the opening and translatable along the guide down into a second position.

In a second aspect, an ice machine includes a housing including a front panel and an opening above the front panel. The ice machine also includes an ice bin within the housing, a guide at or adjacent to an inner surface of the housing, and a door movably coupled to the guide, such that the door is movable from a first position to a second position. The door covers the opening in the first position. The door is located between the front panel and the ice bin when the door is in the second position.

In a third aspect, an ice machine includes a housing. The housing includes a first front panel, a second front panel extending away from the first front panel in a direction towards a rear side of the housing, a first sidewall and a second sidewall opposite the first sidewall, and an opening extending through the second front panel. The first sidewall and the second sidewall extend in directions away from the first front panel, respectively. The ice machine also includes a first guide at or adjacent to an inner surface of the first sidewall, and a second guide at or adjacent to an inner surface of the second sidewall. The ice machine includes a door including a first extension extending away from a first side of the door, and a second extension extending away from a second side of the door. The second side of the door is opposite the first side of the door. The first extension of the door is pivotable within and translatable along the first guide and the second extension of the door is pivotable within and translatable along the second guide, such that the door, from a first position, is pivotable away from the opening and translatable along the first guide and the second guide down into a second position. The door covers the opening in the first position.

DETAILED DESCRIPTION OF THE DRAWINGS

An ice machine of the present embodiments includes a door that pivots within guides within a housing of the ice machine from a closed position, away from an opening of the housing, and into an intermediate position. Once the door is in the intermediate position, the door is translatable along the guides down into an open position. Ice stored within the ice machine is accessible via the opening of the housing when the door is in the open position.

Once the door is in the intermediate position, gravity acts on the door in a direction in line with the guides, and the door moves into the open position with or without guidance from the user. In the open position, at least part of the door is located within the housing of the ice machine. The door includes a handle at an outer surface of the door, at a distance from a top side (e.g., a side of the door closest to a top of the housing when the door is in the closed position).

The motion of the door relative to the housing, the pivoting of the door away from the opening and the translating down into the housing, combined with the location of the handle on the outer surface of the door, provides that the user has little opportunity to contact the inner surface of the door during the process of moving the door from the closed position to the open position. This may reduce the risk of contamination of ice within the ice machine and thus, foodborne illness from contaminated ice.

Figure 1:
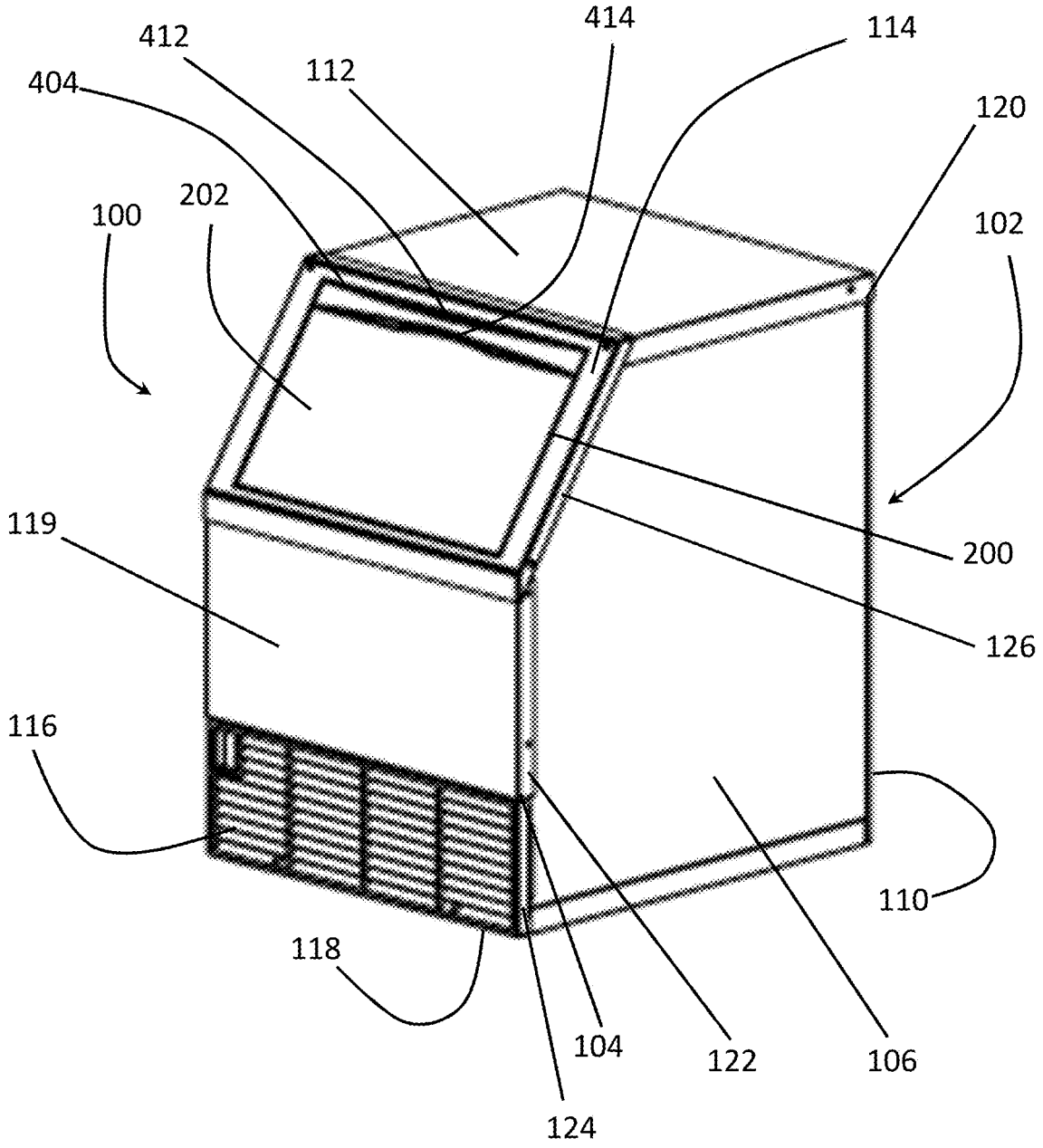
FIG. 1 is a first perspective view of one embodiment of an ice machine.
Figure 2:
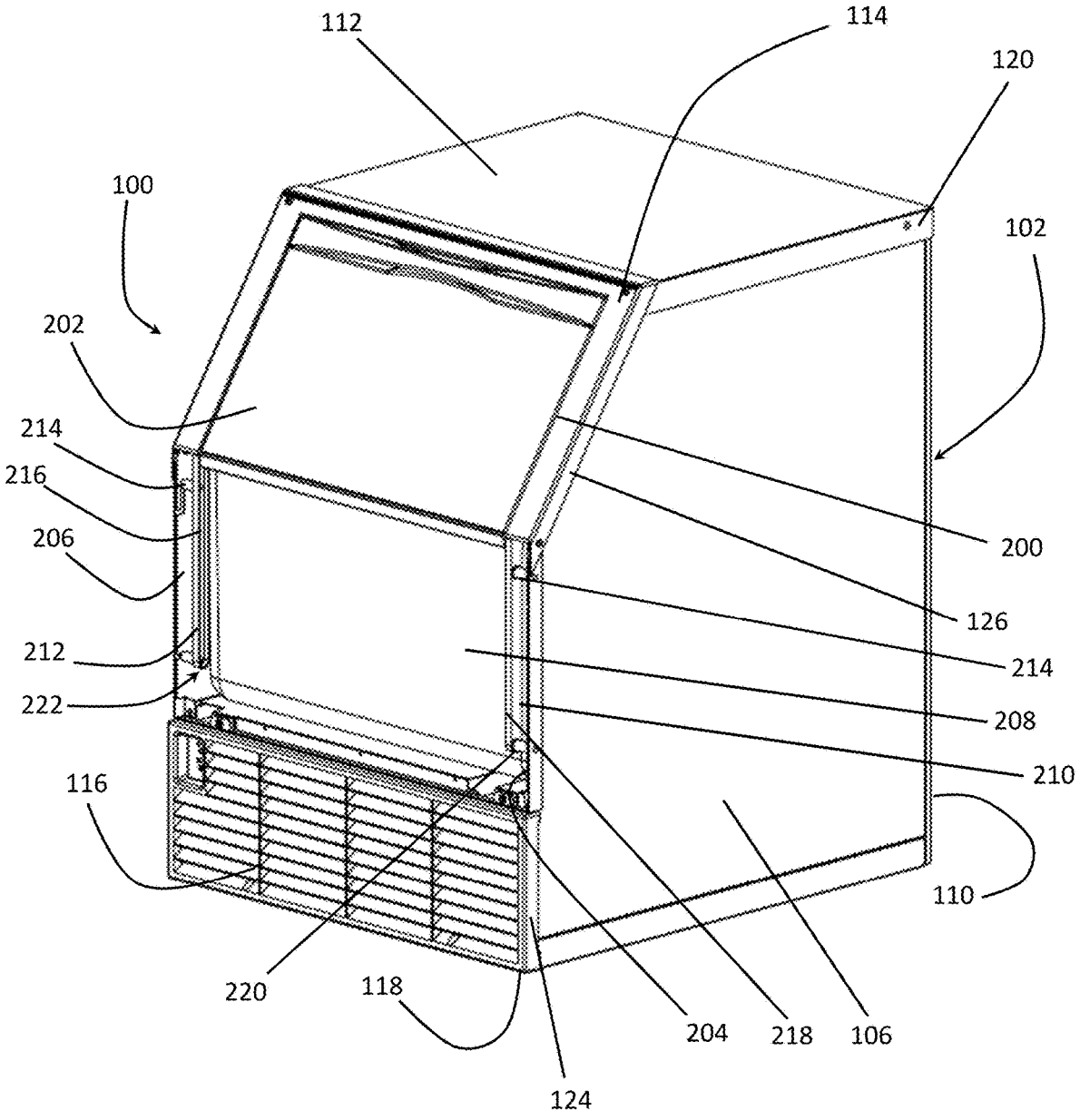
FIG. 2 is a second perspective view of the ice machine of FIG. 1 with a front panel removed.
Figure 3:
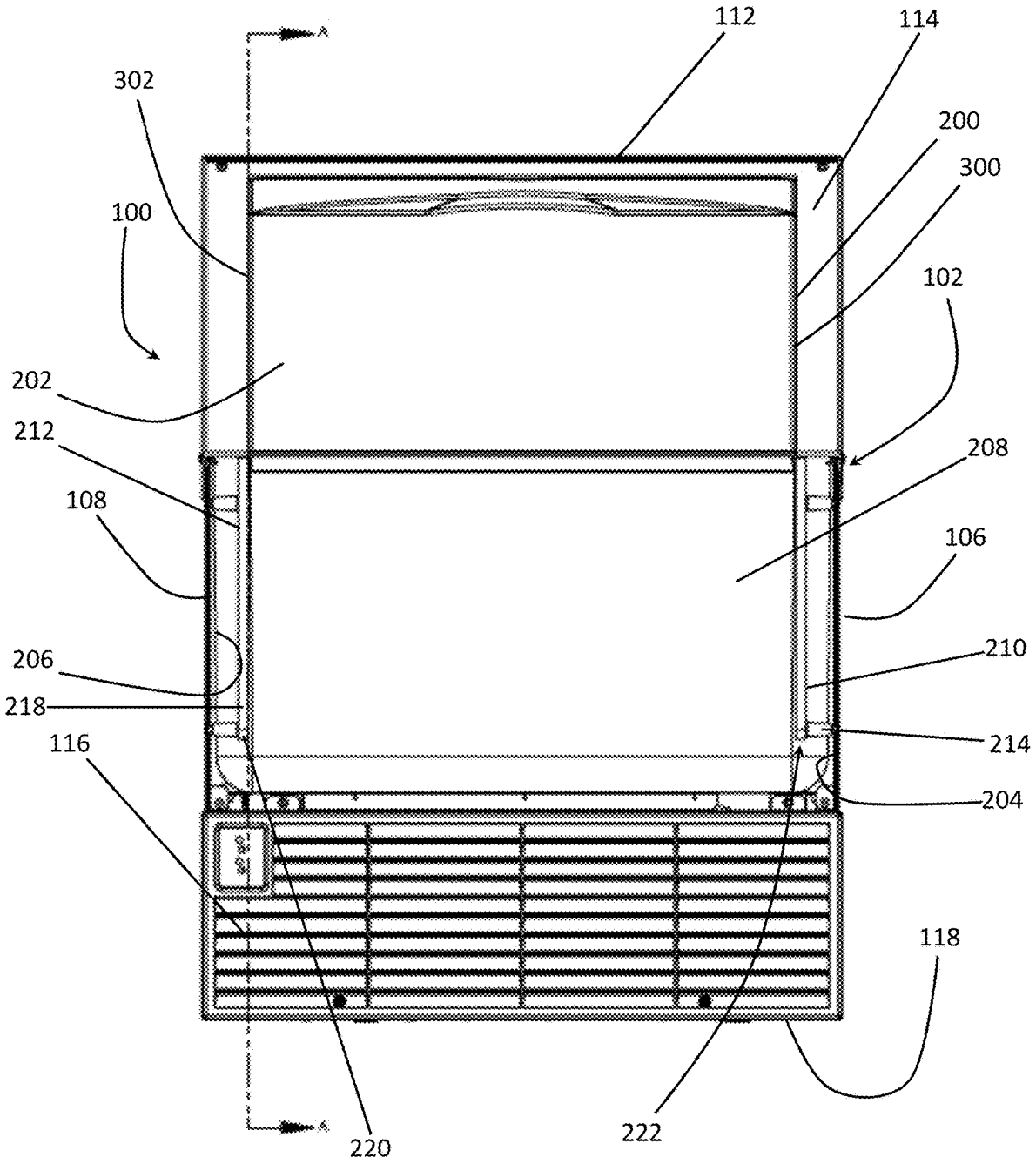
FIG. 3 is a front view of the ice machine of FIG. 1 with a front panel removed.

Turning to the drawings, FIGS. 1-3 illustrate one embodiment of an ice machine 100 (e.g., an icemaker). The ice machine 100 is, for example, an under-counter ice machine. In other embodiments, the ice machine 100 is a different type of ice machine. For example, the ice machine 100 may be an air-cooled ice machine, a water-cooled ice machine, an ice dispenser, an ice bin, or another type of ice machine.

The ice machine 100 includes a housing 102 that protects ice within the ice machine 100 from an environment in which the ice machine 100 is located and keeps the ice cold. The housing 102 may be any number of shapes and sizes based on the type of ice machine. For example, as shown in FIGS. 1-3, the ice machine 100 may be rectangular and may include a first front panel 104, a first sidewall 106, a second sidewall 108 opposite the first sidewall 106, a rear panel 110 opposite the first front panel 104, and a top panel 112. The first sidewall 106 and the second sidewall 108 extend between the first front panel 104 and the rear panel 110. Other shapes and sizes may be provided.

The housing 102 may include more or fewer components. For example, as shown in FIGS. 1-3, the housing 102 may also include a second front panel 114 and a grille 116 (e.g., a third front panel). Air may move into and/or out of the ice machine 100 via different portions of the grille 116, respectively. The second front panel 114 is disposed above the first front panel 104, and the grille 116 is disposed below the first front panel 104. In one embodiment, the housing also includes a bottom panel 118.

The second front panel 114 extends from the first front panel 104 to the top panel 112, in a direction towards the rear panel 110. The second front panel 114 may extend from a top side of the first front panel 104, for example, at any number of angles relative to an outer surface 119 of the first front panel 104. For example, the second front panel 114 may extend from the top side of the first front panel 104 at a 30 degree angle relative to the outer surface 119 of the first front panel 104. In one embodiment, the second front panel 114 extends from the top side of the first front panel 104 at a ninety degree angle relative to the outer surface 119 of the first front panel 104. In such a case, the housing 102 may not include a separate top panel 112, and the second front panel 114 acts as a top panel.

In one embodiment, the housing 102 does not include the rear panel 110, the top panel 112, and/or another panel or sidewall of the housing 102. For example, the housing 102 may not include the top panel 112, and the second front panel 114 extends from the first front panel 104 to a top side of the rear panel 110.

The first front panel 104, the first sidewall 106, the second sidewall 108, the rear panel 110, the top panel 112, the second front panel 114, and the grille 116, for example, may be attached to each other in any number of ways to form the housing 102. For example, the top panel 112 may include flanges 120 on opposite sides of the top panel 112 (e.g., extending away from the opposite sides of the top panel 112 in directions perpendicular to a surface of the top panel 112, respectively, such that a U-shaped top panel 112 is formed), and the top panel 112 may be attached to the first sidewall 106 and the second sidewall 108 via the flanges 120, respectively. The top panel 112 may be attached to the first sidewall 106 and the second sidewall 108 with, for example, fasteners (e.g., nut bolt combinations and/or screws through corresponding openings through the top panel 112, the first sidewall 106, and the second sidewall 108), welds, an adhesive, and/or other connectors.

The first front panel 104 may include flanges 122 on opposite sides of the first front panel 104 (e.g., extending away from the opposite sides of the first front panel 104 in directions perpendicular to a surface of the first front panel 104, respectively, such that a U-shaped first front panel 104 is formed), and the grille 116 may also include flanges 124 on opposite sides of the grille 116 (e.g., extending away from the opposite sides of the grille 116 in directions perpendicular to a surface of the grille 116, respectively, such that a U-shaped grille 116 is formed). The first front panel 104 and the grille 116 may be attached to the first sidewall 106 and the second sidewall 108 with, for example, fasteners (e.g., nut bolt combinations and/or screws through corresponding openings through the first front panel 104, the grille 116, the first sidewall 106, and the second sidewall 108), welds, an adhesive, and/or other connectors.

The second front panel 114 may include flanges 126 at each side of the second front panel 114. The second front panel 114 may be attached to the first front panel 104, the first sidewall 106, the second sidewall 108, and the top panel 112 with, for example, fasteners (e.g., nut bolt combinations and/or screws through corresponding openings through the first front panel 104, the first sidewall 106, the second sidewall 108, and the top panel 112), welds, an adhesive, and/or other connectors.

The rear panel 110 may be attached to the first sidewall 106, the second sidewall 108, the top panel 112, the bottom panel 118, or any combination thereof in any number of ways (e.g., nut bolt combinations and/or screws through corresponding openings through the rear panel 118 and the top panel 112, the first sidewall 106, the second sidewall 108, and/or the bottom panel 118), and the bottom panel 118 may be attached to the first sidewall 106, the second sidewall 108, the rear panel 110, the grille 116, or any combination thereof in any number of ways (e.g., nut bolt combinations and/or screws through corresponding openings through the bottom panel 118 and the first sidewall 106, the second sidewall 108, the rear panel 110, and/or the grille 116).

The first front panel 104, the first sidewall 106, the second sidewall 108, the rear panel 110, the top panel 112, the second front panel 114, the grille 116, and the bottom panel 118 (e.g., sidewalls and panels 104-118) may be separate components attached to each other to form the housing 102. Alternatively, two or more of the sidewall and panels 104-118 may be formed as a single contiguous part of the housing 102. For example, the first sidewall 106, the top panel 112, and the second sidewall 108 may be formed by a single U-shaped part of the housing 102. Other combinations may be provided.

The sidewalls and panels 104-118 may be made of any number of materials. For example, the sidewalls and panels 104-118 may be made of a metal or a plastic. In one embodiment, each of the sidewalls and panels 104-118 is made of a same metal alloy (e.g., composed of steel and chromium and/or nickel). In one embodiment, each of the sidewalls and panels 104-118 is made of two or more materials (e.g., a portion made of the metal alloy and a portion made of a plastic). In one embodiment, at least one of the sidewalls and panels 104-118 is made of at least one material different than at least one other of the sidewalls and panels 104-118. Other materials may be used.

Referring to FIGS. 2 and 3, which show the first front panel 104 of the housing 102 removed, the housing 102 includes an opening 200 through which ice, for example, housed within the ice machine 100 is accessible. In the example shown in FIGS. 2 and 3, the opening 200 is through the second front panel 114. In other embodiments, the opening 200 is through a different panel or sidewall and/or an additional panel or sidewall. The opening 200 may be any number of sizes and shapes. For example, as shown in FIGS. 2 and 3, the opening 200 is rectangular. Other shapes may be provided.

The ice machine 200 also includes a door 202 that is movable between a first position (e.g., a closed position) and a second position (e.g., an open position). The door 202 covers the opening 200 when the door 202 is in the first position. The door 202 may thus be sized and shaped to fully cover the opening 200 when the door 202 is in the first position. For example, the door 202 may be the same shape as the opening 200 (e.g., rectangular) and may be the same size or larger than the opening 200.

For example, the second front panel 114 may include one or more flanges that extend into the opening 200 (e.g., in one or more directions parallel to an outer surface of the second front panel 114, respectively). The door 202 is supported by the one or more flanges within the opening 200 when the door 202 is in the first position.

The second front panel 114 and/or the door 202 may include additional and/or different components to prevent the door 202 from unintentionally slipping out of the first position down into the opening 200 or towards the second position. For example, the door 202 may include one of a latch and a hook, and the second front panel 114 may include the other of the latch and the hook. Other fasteners may be used to keep the door 202 in the first position until the door 202 is moved by the user. In one embodiment, the door 202 and/or the second front panel 114, at the opening 200, may include seals and/or gaskets that increase the friction between the door 202 and the second front panel 114, which may prevent unintended movement of the door 202 relative to the second front panel 114 and may help maintain temperatures within the ice machine 100.

The door 202 may be made of any number of materials. For example, the door 202 may be made of a same material as the other sidewalls and panels 104-118. In one embodiment, the door 202 is made of a different material than at least one of the other sidewalls and panels 104-118. For example, the door 202 is made of a plastic, and the other sidewalls and panels 104-118 are made of the metal alloy. The door 202 may be made of a single material or may be made of more than one material. For example, a first portion of the door 202 (e.g., one or more handles) may be made of the plastic, and a second portion of the door 202 (e.g., the body of the door 202) may be made of the metal alloy.

The first sidewall 106 has an inner surface 204 (e.g., a first inner surface), and the second sidewall 108 has an inner surface 206 (e.g., a second inner surface) that is opposite the first inner surface 204. The first inner surface 204 and the second inner surface 206 face each other, and both the first inner surface 204 and the second inner surface 206 face an ice bin 208 that is disposed within (e.g., supported by and within) the housing 102 of the ice machine 100. The ice bin 208 houses ice within the ice machine 100, and the ice bin 208 is accessible via the opening 200. In one embodiment, the ice machine 100 does not include the ice bin 208, and the ice is disposed within and supported by the housing 102.

The ice machine 100 includes a first guide 210 and a second guide 212 opposite the first guide 210. The first guide 210 is supported by the first sidewall 106 of the housing 102 and is positioned at or adjacent to (e.g., within six inches of) the first sidewall 106; the second guide 212 is supported by the second sidewall 108 of the housing 102 and is positioned at or adjacent to (e.g., within six inches of) the second sidewall 108. The ice machine 100 may include more, fewer, and/or different guides. For example, the ice machine 100 may include a third guide supported by the first front panel 104, at or adjacent to the first front panel 104 (e.g., at or adjacent to an inner surface of the first front panel 104).

As shown in the example of FIGS. 2 and 3, the first guide 210 and the second guide 212 may be embodied as tracks (e.g., a first track 210 and a second track 212) offset from the first inner surface 204 and the second inner surface 206, respectively. For example, the first track 210 is attached to and offset relative to the first inner surface 204 with one or more posts 214 (e.g., two posts; a first set of posts), and the second track 212 is attached to and offset relative to the second inner surface 206 with one or more posts 214 (e.g., two posts; a second set of posts). The first track 210 and the second track 212 may be attached to the first inner surface 204 and the second inner surface 206 via the first set of posts 214 and the second set of posts 214, respectively, in any number of ways including, for example, with corresponding connectors (e.g., screws).

Each of the first track 210 and the second track 212 includes a channel 216 formed by opposing walls 218 extending away from a base 219, and a rounded end portion 220 at a first end 222 (e.g., a bottom end) of the respective track 210, 212. The respective track 210, 212 is open at a second end (e.g., a top end). In one embodiment, the first track 210 and/or the second track 212 does not include a base, but is open between the opposing walls 218 and through the respective track 210, 212. The first track 210 and the second track 212 may extend longitudinally in directions that are, for example, parallel to the inner surface of the first front panel 104. In other embodiments, the first track and the second track 212 may extend longitudinally in directions that are at angles (e.g., a same angle) relative to the inner surface of the first front panel 104.

The first guide 210 and the second guide 212 may be formed in other ways. For example, the channels 216 may be formed within the first inner surface 204 and the second inner surface 206, respectively. In another example, the first guide 210 and the second guide 212 are formed by rails, respectively, and portions of the door 202 ride on the rails, respectively. Other configurations may be provided.

Referring to FIG. 3, the door 202 includes a first side 300 and a second side 302 opposite the first side 300. The first side 300 of the door 202 is closer to the first sidewall 106 than the second sidewall 108, and the second side 302 of the door 202 is closer to the second sidewall 108 than the first sidewall 106.

Figure 4:
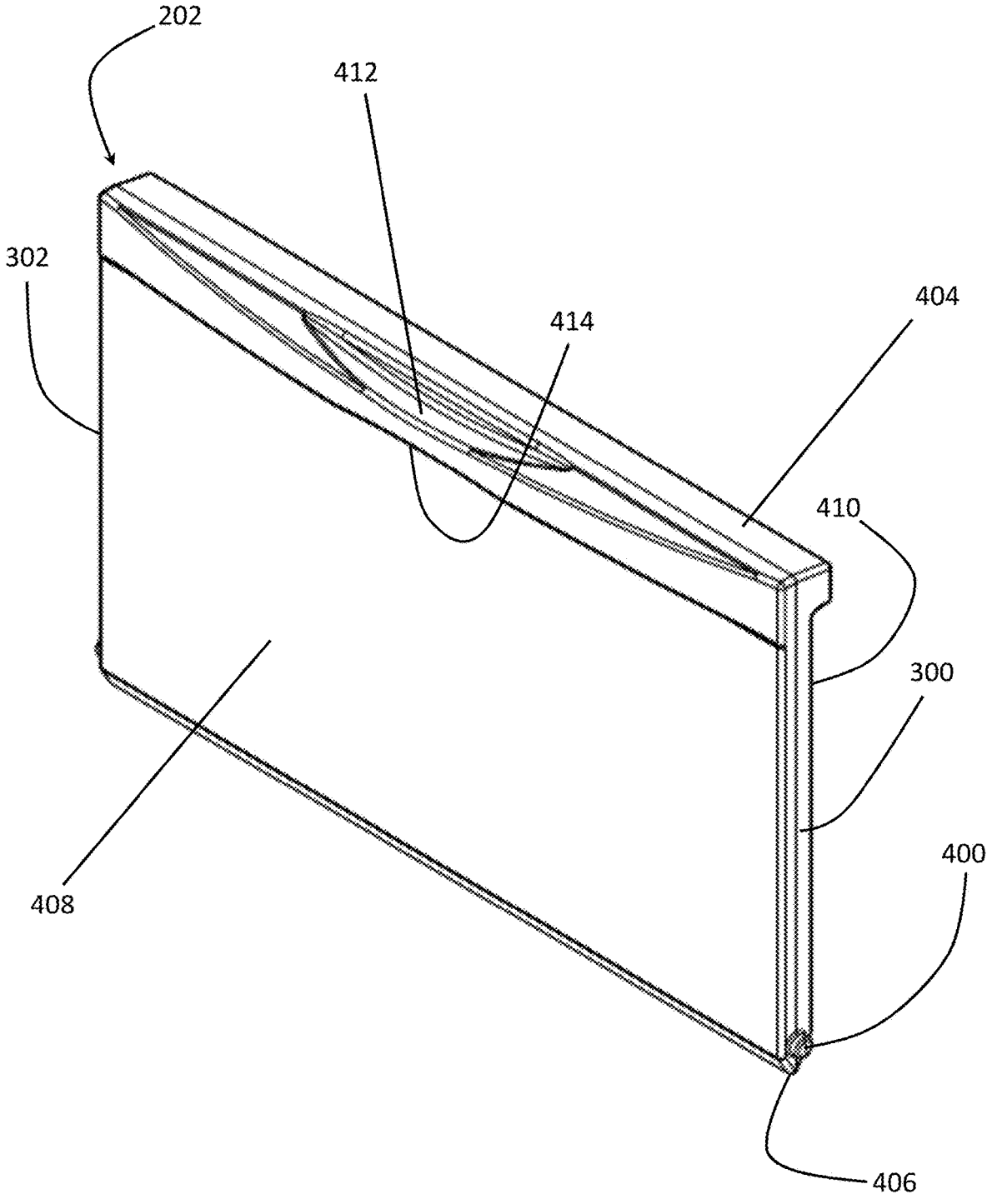
FIG. 4 is a perspective view of one embodiment of a door for an ice machine.
Figure 5:
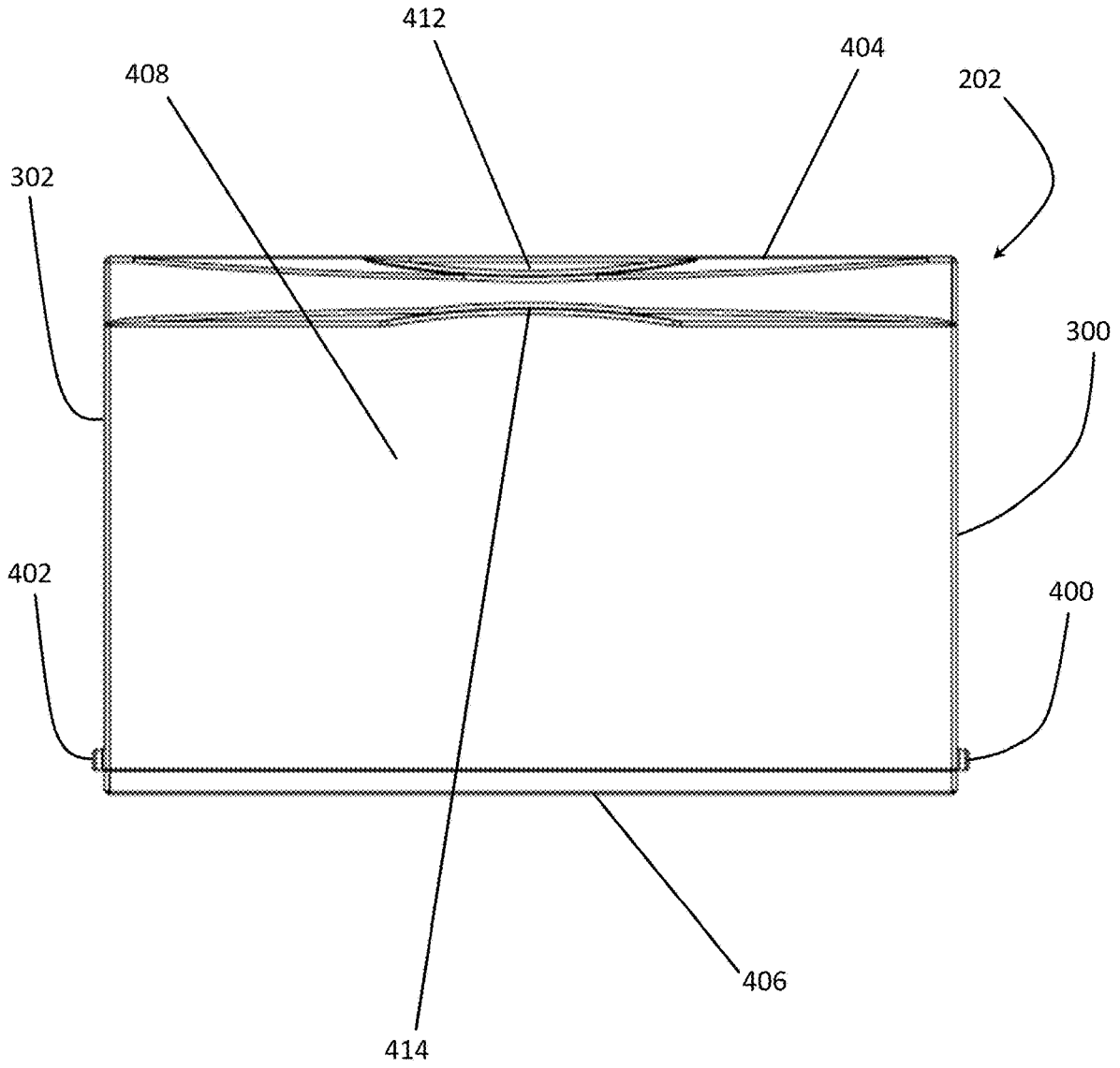
FIG. 5 is a front view of the door of FIG. 5.

Referring to FIGS. 4 and 5, the door 202 includes a first extension 400 extending away from the first side 300 of the door 202, and a second extension 402 extending away from the second side 302 of the door 202. In the example in which the door 202 is rectangular in shape, as shown in FIGS. 4 and 5, the door 202 also includes a third side 404 (e.g., a top side) and a fourth side 406 (e.g., a bottom side) opposite the third side 404. The first side 300 and the second side 302 of the door 202 extend between the third side 404 and the fourth side 406 of the door 202. In the example show in FIGS. 4 and 5, the first extension 400 and the second extension 402 are positioned at or adjacent to (e.g., within three or four inches of) the fourth side 406 of the door 202, though other positioning of the first extension 400 and the second extension 402 may be provided.

The first extension 400 and the second extension 402 may be embodied in any number of ways and may be sized and/or shaped in any number of ways. For example, the first extension 400 and the second extension 402 are bosses or pins that are cylindrically shaped and sized to match a spacing between the opposing walls 218 and a depth of the channels 216 of the first guide 210 and the second guide 212, respectively. Other configurations, shapes, and/or sizes of the first extension 400 and the second extension 402 may be provided. For example, the first extension 400 and the second extension 402 may be wheels that ride in the first track 210 and the second track 212, respectively.

In one embodiment, the door 202 may include additional, fewer, and/or different extensions away from additional, fewer, and/or different sides or surfaces of the door 202. The door 202 has an outer surface 408 and an inner surface 410. In one embodiment, the door 202 includes one or more extensions extending away from the outer surface 408 and/or the inner surface 410, respectively, and the ice machine 100 includes one or more guides corresponding to the one or more extensions, respectively. For example, the outer surface 408 of the door 202 includes two extensions, and an inner surface of the first front panel 104 includes one or more guides that correspond to the one or more extensions extending away from the outer surface 408 of the door 202.

The door 202 may also include at least one handle. As shown in the example of FIGS. 4 and 5, the door 202 includes a first handle 412 and a second handle 414. The first handle 412 is positioned at or adjacent to the top side 404 of the door 202, and the second handle 414 is positioned at a distance away from the top side 404 of the door 202 and the first handle 412. As shown in FIGS. 4 and 5, the first handle 412 and the second handle 414 may be recesses into a portion of the door 202, respectively. For example, the first handle 412 and the second handle 414 may be recesses into opposite sides of a portion of the door 202 that is raised relative to the outer surface 408 of the door 202, respectively (e.g., a stop, as discussed below with reference to FIG. 6). Orientations of the first handle 412 and the second handle 414, respectively, may be parallel to the top side 404 of the door 202.

In one embodiment, the first handle 412 and/or the second handle 414 are recesses into the outer surface 408 of the door 202. The door 202 may include additional, fewer, and/or different handles. For example, the door 202 may include a crescent- or c-shaped handle positioned at a distance from the top side 404 of the door. Other types of handles, other handle positioning, and/or other handle orientation relative to the top side 404 of the door may be provided.

Figure 6:
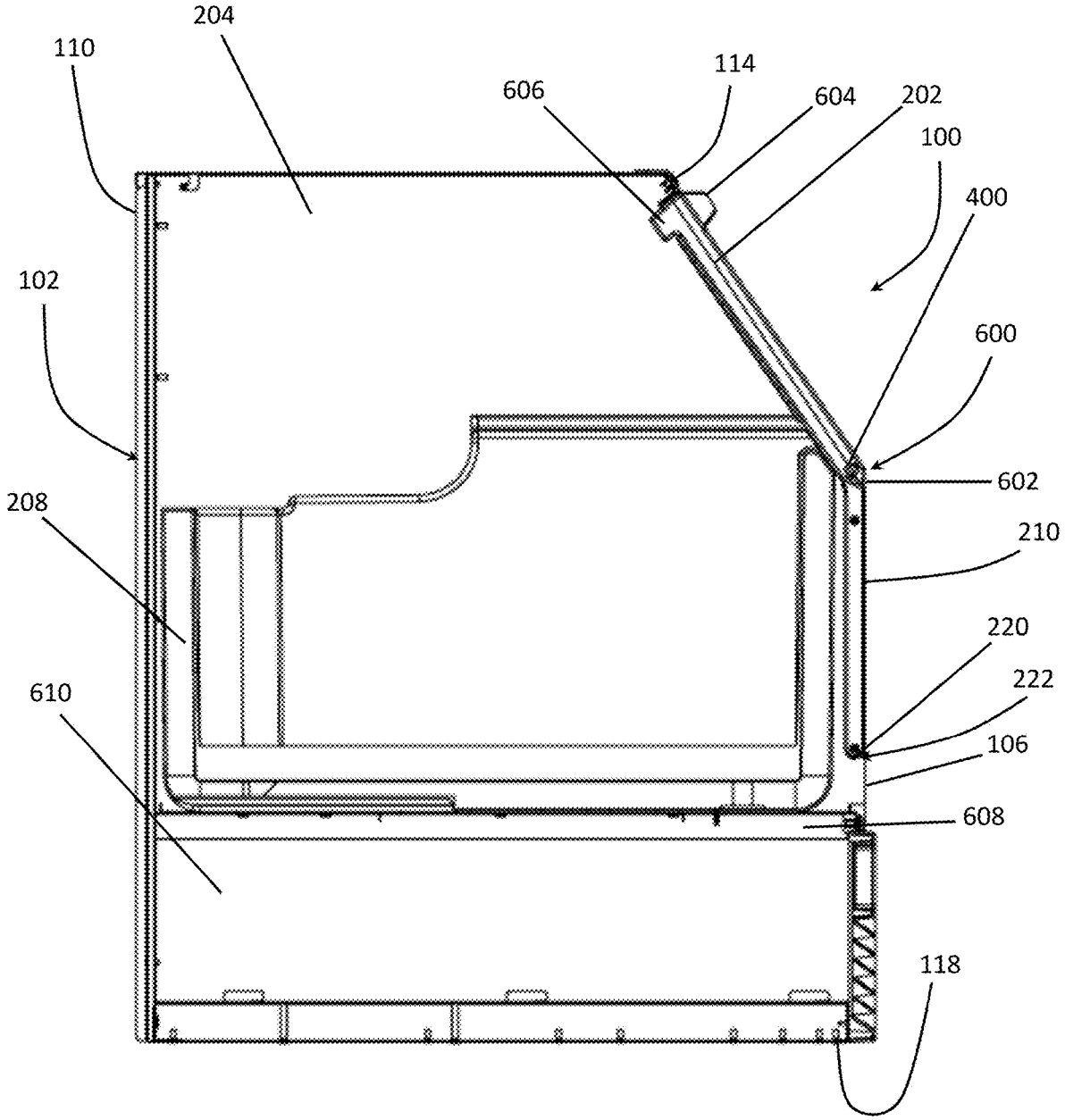
FIG. 6 depicts cross-section A-A of the ice machine of FIG. 3.

Referring to FIG. 6, the door 202 is moveably coupled to the first guide 210 and the second guide 212 via the first extension 400 and the second extension 402, respectively. The first extension 400 is positioned within the first guide 210 and the second extension 402 is positioned within the second guide 212, such that the first extension 400 and the second extension 402 are pivotable within and translatable along the first guide 210 and the second guide 212, respectively.

The door 202 may be removed from the first guide 210 and the second guide 212 at ends 600 (e.g., top ends) of the first guide 210 and the second guide 212, respectively, closest to the second front panel 114. The first guide 210 and the second guide 212 are, for example, open at the ends 600.

The bottom side 406 of the door 202 may include a stop 602 that prevents the door 202 from sliding down along the first guide 210 and the second guide 212 when the door 202 is in the first position. The bottom side 406 of the door 202 may be shaped such that a surface of the door 202 is a mating surface with an inner surface of the first front panel 104 when the door 202 is in the first position. For example, as shown in FIG. 6, the bottom side 406 of the door 202 may be triangularly shaped, and a surface of the triangularly shaped bottom side 406 of the door 202 may abut or be adjacent to the inner surface of the first front panel 104 when the door 202 is in the first position. Other configurations may be provided.

The door 202 and/or the first guide 210 and the second guide 212 may include additional and/or different stops that help maintain the first position and/or the second position of the door 202 unless the door is moved by the user. For example, as shown in FIG. 6, the door 202 may include a first stop 604 that extends away from the outer surface 408 of the door 202. Additionally or alternatively, the door 202 may include a second stop 606 that extends away from the inner surface 410 of the door 202. The first stop 604 and the second stop 606, for example, may extend away from the outer surface 408 of the door 202 and the inner surface 410 of the door 202, respectively, at or adjacent to the top side 404 of the door 202, though other positioning relative to the top side 404 of the door 202 may be provided. The first stop 604 and/or the second stop 606 may be any number of shapes and/or sizes. For example, the first stop 604 and/or the second stop 606 is rectangular-shaped or trapezoidal-shaped and may extend across an entire width (e.g., parallel to a top side 404 of the door 202) of the door 202. In one embodiment, the first stop 604 and/or the second stop 606 extends across less than the entire width of the door 202.

A cross-section of the first stop 604 and/or the second stop 606, respectively, may not change across the width of the door 202. Alternatively, the cross-section of the first stop 604 and/or the second stop 606, respectively, may vary across the width of the door 202. For example, the cross-section of the first stop 604 and/or the second stop 606, respectively, may vary with a decrease in height from a central maximum towards the first side 300 of the door 202 and the second side 302 of the door 202, respectively, such that the first stop 604 and/or the second stop 606 is curved.

The first stop 604 may abut the first front panel 104, and/or the second stop 606 may abut the ice bin 208 when the door 202 is in the second position. The first stop 604 and the second stop 606 help prevent the door 202 from falling too deep into the housing 102, between the first front panel 104 and the ice bin 208, which would make retrieval of the door 202 difficult.

The ice machine 100 may include additional and/or different stops. For example, the rounded end portions 220 at the first ends 222 of the first track 210 and the second track 212 may act as respective stops, in that the rounded end portions 220 may prevent the first extension 400 and/or the second extension 402 of the door 202 from moving any further into the ice machine 100 and may set the second position of the door 202. Other configurations may be provided. For example, the first track 210 and the second track 212 may not include the rounded end portions 220, and a flange extending away from the inner surface of the first front panel 104, a flange extending away from an outer surface of the ice bin 208, extensions (e.g., bosses or bolts) extending away from the inner surface 204 of the first sidewall 106 and the inner surface 206 of the second sidewall 108, or any combination thereof may abut the door 202 in the second position and act as stops, respectively.

As shown in FIG. 6, the ice bin 208 may be offset relative to the bottom panel 118. The housing 102 may include a support 608 (e.g., a plate or a shelf) that extends between the first front panel 104 and the rear panel 110 and/or between the first sidewall 106 and the second sidewall 108. The support 608 may be, for example, a sheet of metal (e.g., a same material as the first front panel 104, the first sidewall 106, the second sidewall 108, and/or the top panel 112) and may be attached to any number of the sidewalls and panels 104-118 in any number of ways (e.g., with fasteners such as screws). The ice bin 208 is, for example, supported within the housing 102 and offset relative to the bottom panel 118 by the support 608. The offset relative to the bottom panel 118 provided by the support 608, for example, allows the user to access ice housed within ice bin 208 without having to reach too far into the ice machine 100.

The support 608 combined with, for example, the first front panel 104, the first sidewall 106, the second sidewall 108, the bottom panel 118, and the rear panel 110 forms a volume 610 that may house any number of components of the ice machine 100. In an embodiment in which the ice machine 100 is an ice maker (e.g., an air-cooled ice maker), the volume 610 may house a refrigerator (e.g., a compression type refrigerator). The refrigerator may include any number of components stored in the volume 610 including, for example, a condenser, an in line drier, an expansion valve, conduit to an evaporator (e.g., housed in the ice machine 100 above the ice bin 208), suction and heat exchanger conduit, a compressor, additional and/or different conduit, additional and/or different valves, electronics such as one or more processors and one or more memory, other components, or any combination thereof.

FIGS. 1 and 7A-7D show exemplary movement of the door 202 from the first position (e.g., the closed position), in which the door 202 covers the opening 200 through the housing 102, to the second position (e.g., the open position), in which the opening 200 is exposed and ice stored within the ice machine 100 is accessible by the user. FIG. 1 shows the door 202 in the closed position. The user grabs one or both of the first handle 412 and the second handle 414 and pulls the door 202 towards the user (e.g., away from the opening 200). The top end 404 of the door 202 pivots away from the opening 200. The door 202 is coupled to the first track 210 and the second track 212 via the first extension 400 and the second extension 402, respectively, so that when the user pulls the door 202 away from the opening 200, the first extension 400 pivots within the first track 210 and the second extension 402 pivots within the second track 212 and the door 202 pivots away from the opening 200 (see FIG. 7A).

Figures 7A, 7B, 7C, 7D:
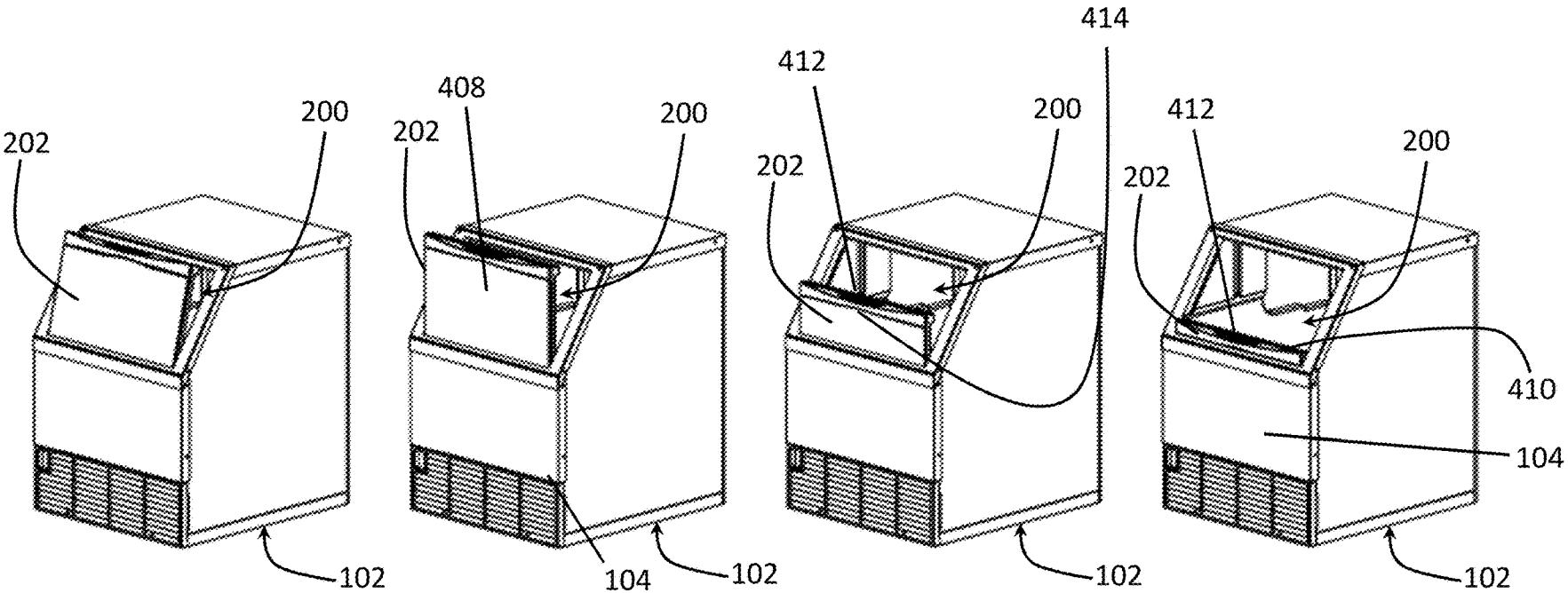
FIGS. 7A-7D illustrate exemplary door motion to open one embodiment of an ice machine.

Referring to FIG. 7B, the door 202 is pivotable away from the opening 200 through the housing 102 until, for example, the outer surface 408 of the door 202 contacts the inner surface of the first front panel 104. The contact of the outer surface 408 of the door 202 with the inner surface of the first front panel 104 may prevent over-rotation of the door 202 and define an intermediate position between the closed position of the door 202 and the open position of the door 202. In other embodiments, other contact between the door 202 and the housing 102, the first track 210, the second track 212, or any combination thereof may prevent over-rotation of the door 202 and define the intermediate position of the door 202. For example, a portion of the first extension 400 (e.g., a projection away from a first boss 400) and a portion of the second extension 402 (e.g., a projection away from a second boss 402) may interact with (e.g., abut) the first track 410 and the second track 412, respectively, when the door 202 is in the intermediate position.

In the intermediate position, the first extension 400 and the second extension 402 of the door 202 are free to translate along the first track 410 and the second track 412, respectively. In other words, in the intermediate position, no surfaces of the housing 102 prevent the door 202 from translating along the first track 410 and the second track 412 and falling into the open position. In the intermediate position, the outer surface 408 of the door 202 may be substantially parallel (e.g., allowing for over- or under-rotation of the door 202 relative to the opening 200 due to tolerances between the first extension 400 and the first track 210 and/or the second extension 402 and the second track 212, respectively; allowing for ten degrees or less over-rotation or under-rotation) to the inner surface of the first front panel 104. Other positioning of the door 202 relative to the first front panel 104 in the intermediate position may be provided.

Referring to FIGS. 7C and 7D, from the intermediate position, the user holding the first handle 412 and/or the second handle 414 is able to slide the door 202 along the first track 210 and the second track 212, for example, (see FIG. 7C) into the open position (see FIG. 7D). Alternatively or additionally, the user may let go of the door 202 and let gravity move the door 202 down into the open position. In one embodiment, the first track 210 and/or the second track 212 includes a respective damper (e.g., a spring damper) to slow translation of the door 202 down into the open position if the user lets go of the door 202 and allows gravity to move the door 202 down into the open position.

One or more stops (e.g., one or more of the stops 602, 604, 606 of the door 202 and/or one or more of the rounded end portions 220 of the first track 210 and the second track 212, respectively) may prevent the door 202 from moving past the open position and further into the housing 102 of the ice machine 100. Referring to FIG. 7D, in the open position of the door 202, the door 202 is located between the first front panel 104 and the ice bin 208. In the embodiment in which the ice machine 100 does not include the ice bin 208, the door 202 is positioned behind the first front panel 104 and abuts or is adjacent to the inner surface of the first front panel 104 when the door is in the open position.

The movement from the closed position to the open position described above may be performed in reverse to move the door 202 from the open position to the closed position. For example, the door 202 may be translated up along the first track 210 and the second track 212 to the intermediate position, and from the intermediate position, may be pivoted towards the opening 200 until the closed position of the door 202 is reached.

The combination of the movement between the closed position and the open position (e.g., pivot away from the opening 200 and translate down into the open position) combined with the location of the first handle 412 and the second handle 414 minimizes the opportunities for the user to contact the inner surface 410 of the door 202. With gravity aiding movement of the door 202 between the intermediate position and the open position, there is no need for the user to let go of the first handle 412 and/or the second handle 414 and contact the inner surface 410 of the door 202. Accordingly, the combination of the movement between the closed position and the open position combined with the location of the first handle 412 and the second handle 414 may reduce the risk of contamination of the ice stored within the ice machine 100.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An ice machine comprising:

a housing comprising:

a front panel;

a first sidewall and a second sidewall opposite the first sidewall, the first sidewall and the second sidewall extending in directions away from the front panel, respectively; and an opening;

a guide at or adjacent to an inner surface of the first sidewall, an inner surface of the second sidewall, or an inner surface of the front panel; and a door movably coupled to the guide, wherein from a first position of the door, the door is pivotable away from the opening and translatable along the guide down into a second position.

2. The ice machine of claim 1, further comprising an ice bin within the housing, wherein the door is located between the front panel and the ice bin when the door is in the second position.

3. The ice machine of claim 2, wherein the front panel is a first front panel, wherein the housing further comprises:

a rear panel, the first sidewall and the second sidewall extending between the first front panel and the rear panel;

a second front panel extending away from the first front panel in a direction towards the rear panel; and a top panel attached to the first sidewall, the second sidewall, the rear panel, the second front panel, or any combination thereof, and wherein the second front panel includes the opening, the ice bin being accessible through the opening.

4. The ice machine of claim 3, wherein the door is supported by the second front panel and covers the opening of the second front panel when the door is in the first position.

5. The ice machine of claim 4, wherein a surface of the door and the inner surface of the first front panel are mating surfaces when the door is in the first position.

6. The ice machine of claim 3, wherein the door has an outer surface and an inner surface opposite the outer surface, wherein the door comprises a first stop extending away from the inner surface at or adjacent to a side of the door closest to the top panel, a second stop extending away from the outer surface at or adjacent to the side of the door closest to the top panel, or the first stop and the second stop, and wherein the first stop abuts the ice bin when the door is in the second position, the second stop abuts the first front panel when the door is in the second position, or a combination thereof.

7. The ice machine of claim 3, wherein the door comprises a handle, wherein the handle is positioned at a distance from a side of the door closest to the top panel.

8. The ice machine of claim 1, wherein the door is pivotable away from the opening into an intermediary position, an outer surface of the door being substantially parallel to the inner surface of the front panel in the intermediary position.

9. The ice machine of claim 1, wherein a portion of the door is pivotable within and translatable along the guide, such that the door is movable between the first position and the second position.

10. The ice machine of claim 9, wherein the portion of the door that is pivotable within and translatable along the guide comprises a boss extending away from a side of the door.

11. The ice machine of claim 1, wherein the guide is a first guide at or adjacent to the inner surface of the first sidewall, and the portion of the door is a first portion of the door, wherein the ice machine further comprises a second guide at or adjacent to an inner surface of the second sidewall, the second guide being opposite the first guide, and wherein a second portion of the door is pivotable within and translatable along the second guide.

12. The ice machine of claim 1, wherein the guide is a track within which and along which the portion of the door is movable, wherein the ice machine further comprises a stop at the end of the track, and wherein the portion of the door abuts the stop when the door is in the second position.

13. The ice machine of claim 12, wherein an end portion of the track forms the stop.

14. An ice machine comprising:

a housing comprising:

a front panel; and an opening above the front panel;

an ice bin within the housing;

a guide at or adjacent to an inner surface of the housing; and a door movably coupled to the guide, such that the door is movable from a first position to a second position, the door covering the opening in the first position, wherein the door is located between the front panel and the ice bin when the door is in the second position.

15. The ice machine of claim 14, wherein the front panel is a first front panel, wherein the housing further comprises:

a first sidewall and a second sidewall opposite the first sidewall, the first sidewall and the second sidewall extending in directions away from the first front panel, respectively; and a second front panel extending away from the first front panel in a direction towards a rear side of the housing, and wherein the second front panel includes the opening, the ice bin being accessible through the opening.

16. The ice machine of claim 15, wherein the guide is at or adjacent to an inner surface of the first sidewall or an inner surface of the second sidewall.

17. The ice machine of claim 16, wherein the guide is a first guide at or adjacent to the inner surface of the first sidewall, and wherein the ice machine further comprises a second guide at or adjacent to the inner surface of the second sidewall, the second guide being opposite the first guide.

18. The ice machine of claim 17, wherein the door comprises:

a first boss that extends away from a first side of the door; and a second boss that extends away from a second side of the door, the second side being opposite the first side, and wherein the first boss is pivotable within and translatable along the first guide, and the second boss is pivotable within and translatable along the second guide.

19. The ice machine of claim 14, wherein from the first position of the door, the door is pivotable within the guide, away from the opening and translatable along the guide down into the second position.

20. An ice machine comprising:

a housing comprising:

a first front panel;

a second front panel extending away from the first front panel in a direction towards a rear side of the housing;

a first sidewall and a second sidewall opposite the first sidewall, the first sidewall and the second sidewall extending in directions away from the first front panel, respectively; and an opening extending through the second front panel;

a first guide at or adjacent to an inner surface of the first sidewall, and a second guide at or adjacent to an inner surface of the second sidewall; and a door comprising:

a first extension extending away from a first side of the door; and a second extension extending away from a second side of the door, the second side of the door being opposite the first side of the door, wherein the first extension of the door is pivotable within and translatable along the first guide and the second extension of the door is pivotable within and translatable along the second guide, such that the door, from a first position, is pivotable away from the opening and translatable along the first guide and the second guide down into a second position, and wherein the door covers the opening in the first position.

* * * * *